US006679217B2

(12) United States Patent
Nieda et al.

(10) Patent No.: US 6,679,217 B2
(45) Date of Patent: Jan. 20, 2004

(54) STARTER

(75) Inventors: Seiichi Nieda, Tokyo (JP); Hideki Hashiba, Tokyo (JP); Hiroji Kawasaki, Tokyo (JP); Junichi Akaike, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 51 days.

(21) Appl. No.: 10/086,065

(22) Filed: Feb. 28, 2002

(65) Prior Publication Data

US 2002/0121258 A1 Sep. 5, 2002

(30) Foreign Application Priority Data

Mar. 1, 2001 (JP) ..... 2001-056455
Aug. 31, 2001 (JP) ..... 2001-262620

(51) Int. Cl.[7] ..... F02N 1/00; F02N 3/00

(52) U.S. Cl. ..... 123/185.14; 123/185.3; 185/41 A

(58) Field of Search ..... 123/185.2, 185.3, 123/185.4, 185.1, 185.14; 185/41 A, 40 R, 39

(56) References Cited

U.S. PATENT DOCUMENTS

| | | | | |
|---|---|---|---|---|
| 3,010,443 A | | 11/1961 | Lyvers | 123/179 |
| 3,164,142 A | | 1/1965 | Anderson et al. | 123/185.14 |
| 3,306,277 A | | 2/1967 | Gudmundsen | 123/185.14 |
| 3,861,374 A | | 1/1975 | Dooley et al. | 123/185.14 |
| 4,848,288 A | | 7/1989 | Murase et al. | 123/179 |
| 4,850,233 A | | 7/1989 | Ishigo | 74/6 |
| 5,287,832 A | | 2/1994 | Uhl | 123/185 |
| 5,537,966 A | | 7/1996 | Ohnishi | 123/185.14 |
| 6,508,220 B1 | * | 1/2003 | Akaike et al. | 123/185.14 |
| 2003/0037750 A1 | * | 2/2003 | Ueda et al. | 123/185.14 |

FOREIGN PATENT DOCUMENTS

| | | |
|---|---|---|
| DE | 10040997 | 4/2001 |
| JP | 5223025 | 6/1977 |
| JP | 1091075 | 6/1989 |
| JP | 63188 | 1/1994 |
| JP | 717810 | 4/1995 |
| JP | 724614 | 6/1995 |
| JP | 724615 | 6/1995 |
| JP | 2013171 | 1/1999 |

* cited by examiner

*Primary Examiner*—Henry C. Yuen
*Assistant Examiner*—Arnold Castro
(74) *Attorney, Agent, or Firm*—Baker Botts LLP

(57) ABSTRACT

A recoil starter wherein unidirectional rotating means is enabled to sustain a larger magnitude of torque, obviating the employment of parts which are high in mechanical strength, in rigidity and in working precision, thus making it possible to reduce the weight and the manufacturing cost thereof. The recoil starter includes a driving member, a driven member, and buffering/power-accumulating means interposed between the driving member and the driven member. The buffering/power-accumulating means is enabled, during the driving process, to accumulate the power supplied through the driving process while alleviating impact to the driven member. The accumulated power is subsequently employed to drive the driven member. The recoil starter includes a spiral spring mechanism having a housing adjacent to the driving member, an actuating pulley adjacent to the driven member, a buffering/power-accumulating member interposed between the housing and the actuating pulley, and unidirectional rotating means for permitting rotation of the housing unidirectionally in a driving direction, where the unidirectional rotating means is disposed on the outer peripheral side of the spring housing.

9 Claims, 8 Drawing Sheets

STARTER

BACKGROUND OF THE INVENTION

1. Technical Field of the Invention

The present invention relates to a recoil starter for an internal combustion engine, and in particular, to a recoil starter having buffering/power-accumulating means interposed between a driving member and a driven member.

2. Description of the Related Art

A conventional recoil starter which is designed to be mounted on an internal combustion engine is generally provided with a driving member having a rope reel around which a recoil rope is wound, and a driven (idler) member comprising a centrifugal ratchet mechanism. In order to start the internal combustion engine, the recoil rope (recoil handle) is pulled to revolve the rope reel. The resulting revolution of the rope reel is then transmitted, via the driven member, to the crankshaft of the internal combustion engine to thereby start the engine.

The present inventors have heretofore proposed a modification of the aforementioned recoil starter in Japanese Patent Application No. H11-238642. In the modified recoil starter, a spiral spring mechanism is interposed as buffering/power accumulating means between the driving member and the driven member. Since the spiral spring mechanism is interposed between the driving member and the driven member, a load from the engine side may be buffered while the recoil rope is pulled during the first-half of the driving process, namely, until the piston of the internal combustion engine reaches the top dead center thereof. Moreover, the pulling force of the recoil rope is simultaneously accumulated in the spiral spring mechanism. During the second-half of the driving process, the pulling force accumulated in the spiral spring mechanism during the first-half of the driving process is combined with the pulling force effected in the second-half of the driving process to thereby generate a resulting force, which is utilized for starting the internal combustion engine.

As a result, it is possible to minimize a fluctuation in the pulling force of the rope so as to smooth the rope-pulling operation, thus enabling even a person having a weak physical strength to easily start the engine.

However, this type of conventional recoil starter requires unidirectional rotating means having a one-way clutch, in order to prevent the spiral spring mechanism from reversely rotating together with the rope reel. In other words, in order to enable the spiral spring mechanism (of the spiral spring case) to rotate only in the driving direction (the direction of rewinding the spiral spring) when the recoil rope is rewound, unidirectional rotating means, with a one-way clutch, is interposed between the inner peripheral portion (the cylindrical boss portion) of the spiral spring case and a fastening shaft which is fixed to a starter case.

Since the one-way clutch is interposed between the inner peripheral portion of the spiral spring and the fastening shaft, the diameter of the one-way clutch is inevitably required to be relatively small. Hence, it is difficult to make the one-way clutch sustain a large magnitude of torque. Furthermore, the components of a recoil starter of this type are required to be mechanically strong, rigid and precise, thus making the recoil starter inevitably larger in weight and more expensive.

Accordingly, there exists a need in the art for a recoil starter which can overcome the aforementioned disadvantages associated with the conventional recoil starter with unidirectional rotating means having a one-way clutch.

SUMMARY OF THE INVENTION

An object of the present invention is to provide a recoil starter having an improved unidirectional rotating means which is capable of sustaining larger magnitudes of torque thereby making it possible to utilize parts of lower mechanical strength and precision, to lighten the weight thereof, to reduce the manufacturing cost thereof, and to simplify the working and assembling thereof.

These and other objects of the invention, which will become apparent with reference to the disclosure herein, are accomplished by the recoil starter according to the present invention, which comprises a driving member, a driven (idler) member, and buffering/power-accumulating means interposed between the driving member and the driven member. The buffering/power accumulating means includes a housing disposed in the proximity of the driving member, an actuating pulley disposed in the proximity of the driven member, a buffering/power accumulating member interposed between the housing and the actuating pulley, and unidirectional rotating means disposed on the outer peripheral side of the housing for unidirectionally rotating the housing. The buffering/power-accumulating means is adapted, during a driving process of the driving member, to buffer a load from an engine side and to accumulate a force supplied by the driving of the driving member while alleviating impact to the driven member, and the driven member is arranged to be actuated by the accumulated power.

In a preferred embodiment, the unidirectional rotating means includes a one-way clutch. The one-way clutch preferably includes one or more claw members swingably supported by one of the fixing portion of a starter case and the housing, one or more urging members for urging the one or more claw members toward the other of the starter case and the housing, and one or more engaging portions provided on the other of the starter case and the housing, wherein at least one of the claw members is adapted to be engaged with at least one of the engaging portions, thereby preventing the housing from being rotated in the direction opposite to the driving direction.

Preferably, the one-way clutch includes two claw members which are mounted on the starter case so as to be disposed around the rotational axis of the housing and equally spaced from each other at an angle of 180 degrees. The one-way clutch in the preferred embodiment also includes three engaging portions which are provided in the housing and spaced from each other at an angle of 120 degrees.

Alternatively, the one-way clutch may include two claw members mounted on the starter case so as to be disposed around the rotational axis of the housing and spaced apart at angle of 180 degrees, with four engaging portions which are provided in the housing and equally spaced apart from each other at an angle of 90 degrees.

The buffering/power-accumulating means preferably includes a spiral spring mechanism comprising a spiral spring as a buffering/power-accumulating member, and a spiral spring case functioning as the aforementioned housing.

The driving member preferably includes a rope reel having a recoil rope wound therearound, with recoiling urging means for reversely revolving the rope reel so as to rewind the recoil rope, and with a recoil ratchet mechanism for transmitting the torque of the rope reel to the housing.

The driven member preferably includes an interlocking pulley having a power transmission mechanism, through which the driven member is interlockingly coupled with the driving member.

The power transmission mechanism is preferably constituted by a centrifugal ratchet mechanism.

Preferably, the spiral spring comprises an outer circumferential wound portion where a predetermined number of turns of the outer portion of the spiral spring are closely contacted with each other under a freely released condition of the spiral spring, and an inner circumferential wound portion which is constituted by at least one turn of the inner portion of the spiral spring, wherein a clearance is provided between the outer circumferential wound portion and the inner circumferential wound portion. In a more preferred embodiment, the outer circumferential wound portion is constituted by a third turn and the following turns successive to the third turn, and the inner circumferential wound portion is constituted by a first turn and at least a portion of the second turn which is closely contacted with the first turn.

According to the preferable embodiments of recoil starter of the present invention as described above, the unidirectional rotating means e.g., a one-way clutch for unidirectionally rotating the housing, is disposed on the outer peripheral side of the housing, thus allowing the diameter of the aforementioned unidirectional rotating means to be increased. Consequently, in contrast to the conventional recoil starter where the unidirectional rotating means are interposed between the inner peripheral portion of the spiral spring and the fastening shaft, it becomes possible according to this improvement to make the one-way clutch mechanism sustain a torque of large magnitude. Additionally, it is no longer necessary that the component parts have high mechanical strength, rigidity or precision. As a result, the manufacturing cost of the recoil starter can be reduced while, at the same time, its reliability can be improved and its weight reduced.

In accordance with the invention, the objects as described above have been met, and the need in the art for a recoil starter that is light and has a compact configuration, and which has enhanced reliability, has been satisfied.

BRIEF DESCRIPTION OF THE DRAWING

Further features of the invention, its nature and various advantages will be more apparent from the accompanying drawings and the following detailed description of illustrative embodiments.

DETAILED DESCRIPTION OF THE EXEMPLARY EMBODIMENTS

The present invention will be further explained with reference to the drawings depicting embodiments of the recoil starter according to the present invention.

Figure 1:
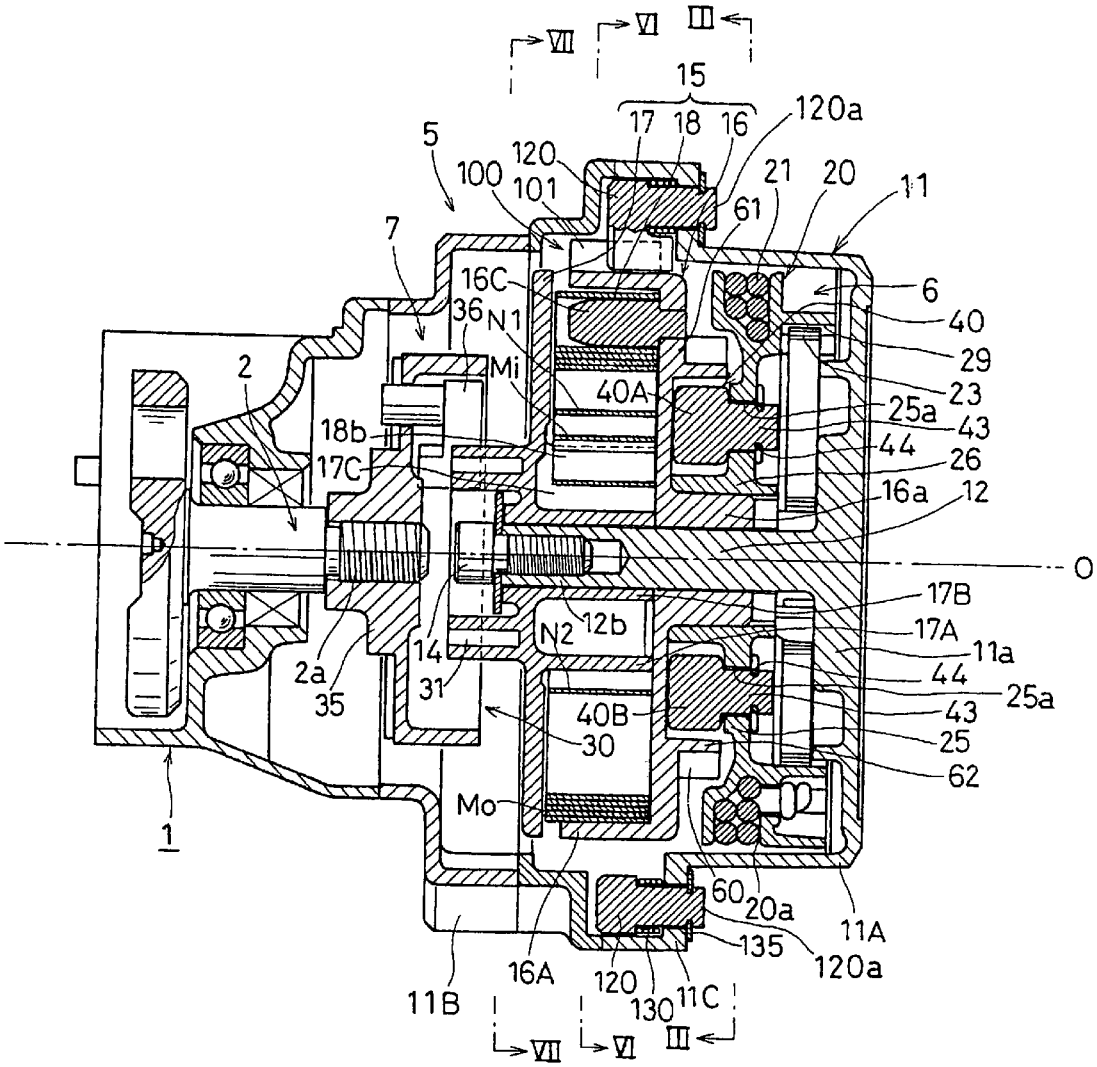
FIG. 1 is a cross-sectional view illustrating one embodiment of a recoil starter in accordance with the present invention.

FIG. 1 is a cross-sectional view of illustrating one embodiment of recoil starter in accordance with the present invention. Referring to FIG. 1, the recoil starter 5 is designed to be disposed adjacent to an end 2*a* of a crankshaft 2 of an internal combustion engine 1, such as a small air-cooled internal combustion engine of 23 mL to 50 mL in displacement. The recoil starter 5 comprises a starter case 11 which is adapted to be mounted on one sidewall of the internal combustion engine 1. The starter case 11 includes two components forming a cylindrical structure. Inside an outer case member 11A of the starter case 11, which is located away from the internal combustion engine 1, there is disposed a driving member 6 which is adapted to be revolved as a recoil rope 21 is pulled via a recoil handle 22. Inside an inner case member 11B of the starter case 11, which is located close to the internal combustion engine 1, there is disposed a driven member 7 which is adapted to be revolved independently of the driving member 6.

In this embodiment, the starter case 11 is preferably made of plastic, and the outer case member 11A is provided with a radially enlarged portion 11C located where the outer case member 11A is joined with the inner case member 11B (i.e. one end thereof facing the internal combustion engine 1). The outer case member 11A is also provided with an anchoring shaft 12 which is integral with and extends coaxially from the thickened center of the top portion 11A thereof. A rope reel 20 having the recoil rope 21 wound therearound is rotatably fitted on the proximal end portion of the anchoring shaft 12. A buffering/power-accumulating spiral spring mechanism 15, comprising a buffering/power-accumulating spiral spring 18 as a buffering/power-accumulating member, a spiral spring case 16 acting as the aforementioned housing, and an actuating pulley 17, is rotatably fitted on the protruded end portion of the anchoring shaft 12, i.e. at an intermediate portion between the rope pulley 20 and an interlocking pulley 35 constituting a driven member 7, so as to permit the buffering/power-accumulating spiral spring mechanism 15 to rotate independently of the rope pulley 20. Additionally, a stopper screw 14 is screw-engaged with the protruded end portion of the anchoring shaft 12.

In this embodiment, the central axial line of the anchoring shaft 12, the rotational axial line of the rope pulley 20, the rotational axial line of the buffering/power-accumulating spiral spring mechanism 15, and the rotational axial line of the interlocking pulley 35 constituting the driven member 7 are all disposed so as to lie on the rotational axial line O of the crankshaft 2, so that the rotation of the rope pulley 20 is enabled to be transmitted via the buffering/power-accumulating spiral spring mechanism 15 and the interlocking pulley 35 to the crankshaft 2 of the internal combustion engine 1.

Figure 4:
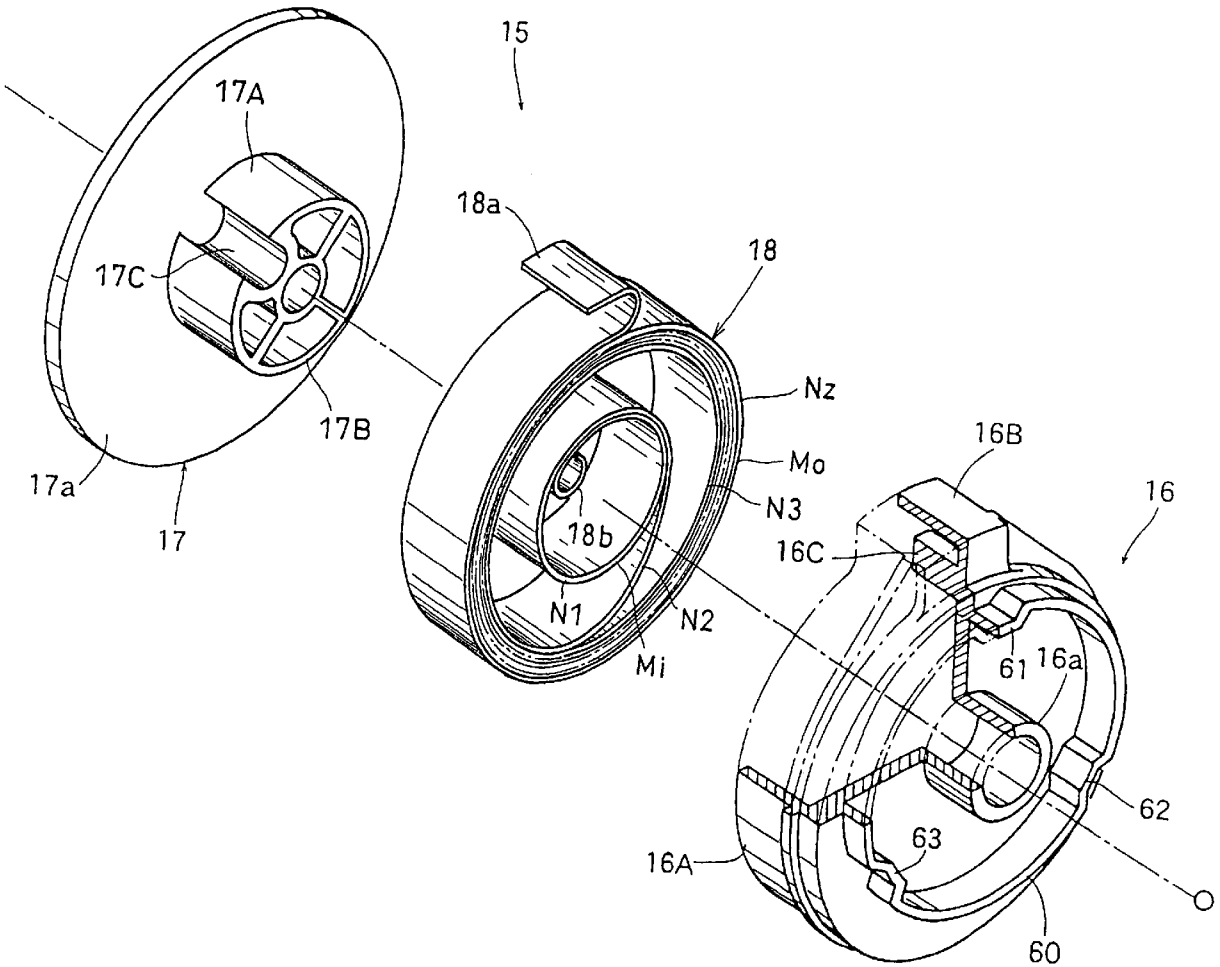
FIG. 4 is a partially exploded perspective view illustrating a spiral spring mechanism which is designed to be installed in the recoil starter shown in FIG. 1.
Figure 5:
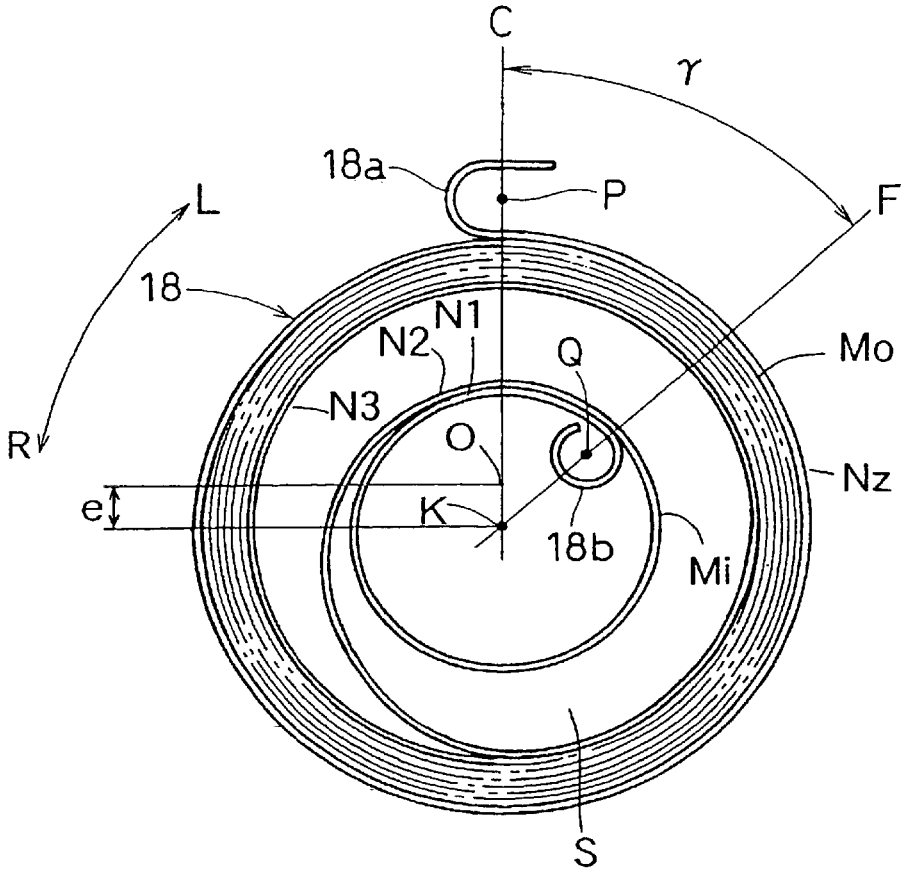
FIG. 5 is an enlarged view illustrating a freely released state of the spiral spring before the spiral spring is installed in the recoil starter of FIG. 1.
Figure 6:
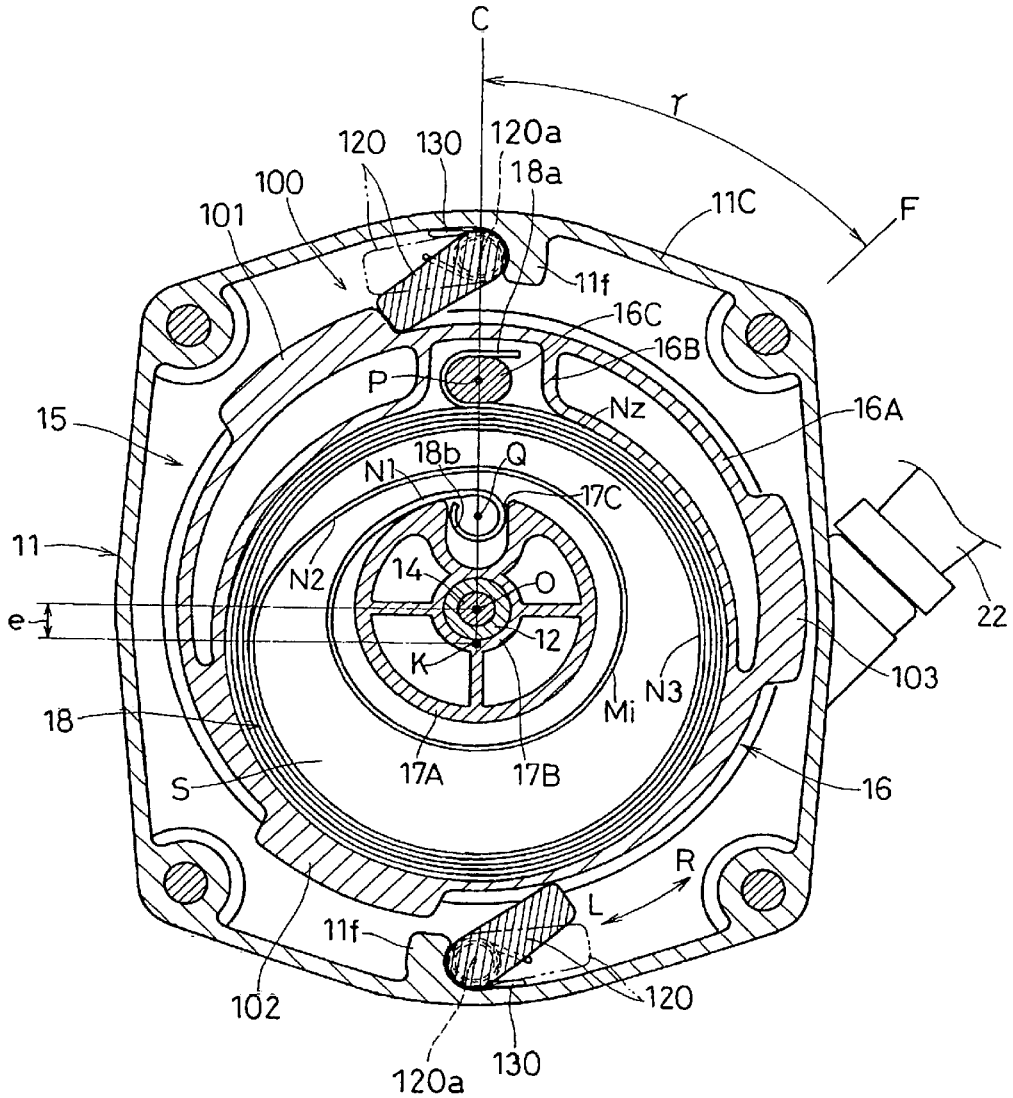
FIG. 6 is a cross-sectional view of the recoil starter taken along the line VI—VI of FIG. 1.

As illustrated in FIGS. 4 to 6 in addition to FIG. 1, the buffering/power-accumulating spiral spring mechanism 15 includes a spiral spring case 16 which is disposed adjacent to the driving member 6, the actuating pulley 17 which is disposed adjacent to the driven member 7, and the spiral spring 18 which is interposed between the spiral spring case 16 and the actuating pulley 17, wherein the buffering/power-accumulating spiral spring 18 is interposed between the spiral spring case 16 disposed on the input side and the actuating pulley 17 disposed on the output side. Further, the spiral spring case 16 and the actuating pulley 17 are coaxially arranged so as to lie on the same axis, thereby enabling them to be rotated relative to each other. As described hereinafter, the outer end portion of the spiral spring 18 is secured to the spiral spring case 16, while the inner end portion thereof is secured to the actuating pulley 17, so that when either one of the spiral spring case 16 and the actuating pulley 17 is rotated relative to the other, its torque is capable of being transmitted to the other.

As shown in FIG. 5, the spiral spring 18 is illustrated as taken out of the spiral spring mechanism 15 (a freely released state thereof before being assembled). The spiral spring 18 is provided, at the outer end portion thereof with a U-shaped external hook end 18*a*, and at the inner end portion thereof with an annular internal hook end 18*b*. In a freely released state of the spiral spring 18, an outer circumferential wound portion Mo, with a predetermined number of turns of the spiral spring 18 in close contact, and an inner circumferential wound portion Mi with at least one turn, are formed. A clearance S is also provided between the outer circumferential wound portion Mo and the inner circumferential wound portion Mi.

In this embodiment, the outer circumferential wound portion Mo includes a third turn N3 of the spiral spring 18 and the subsequent turns (including the outermost turn Nz). The inner circumferential wound portion Mi includes a first turn N1 of the spiral spring 18 and at least a portion of the second turn N2 which is in close contact with the first turn N1. Furthermore, in a freely released state of the spiral spring 18 as shown in FIG. 5, the annular internal hook end 18*b* is positioned so as to be displaced from the location of the external hook end 18*a* by a predetermined angle (40 to 50 degrees in this embodiment) toward the direction L, which is opposite to the driving direction R to be explained hereinafter. The angle is an angle formed between a straight line C, passing through the center K of the spiral spring 18 and through the center P of the external hook end 18*a* (or of an external end-fastening stub 16C which is formed in the spiral spring case 16), and a straight line F passing through the center K of the spiral spring 18 and through the center Q of the internal hook end 18*b* (or of an internal end-fastening portion 17C which is formed in the actuating pulley 17 as explained hereinafter).

The spiral spring 18 may be formed of a stainless steel sheet having a thickness of 0.5 to 0.7 mm, with the effective inner diameter of the first turn N1 set to about 30 mm. An annealing treatment may be performed on the inner circumferential wound portion Mi of the spiral spring 18 (at least the first turn N1 and the second turn N2 thereof).

As shown in FIG. 1, the spiral spring case 16 is provided, at the center of a sidewall thereof facing the driving member 6, with a cylindrical boss portion 16*a*, which is externally and rotatably fitted on the anchoring shaft 12. On the outer periphery of the spiral spring case 16, there is disposed, as unidirectional rotating means, a one-way clutch 100 which permits the spiral spring case 16 to rotate only in the driving direction R (in the rewinding direction of the spiral spring 18) (as described in detail hereinafter).

The spiral spring case 16 further includes, on one of its sidewalls facing the driven member 7, a projected short cylindrical portion 16A for housing the spiral spring 18. This spiral spring-housing cylindrical portion 16A is provided with a disengagement-preventing protruded portion 16B which is outwardly projected in the radial direction for housing therein the external hook end 18*a* of the spiral spring 18. Inside this protruded portion 16B, there is disposed an external end-fastening stub 16C having an oval cross-section, which is protruded toward the driven member 7 so as to be fixedly fitted with the external hook end 18*a*.

The actuating pulley 17 is provided, at the center of its sidewall facing the driving member 6, with a projected cylindrical boss portion 17B which is rotatably fitted on the anchoring shaft 12. The cylindrical boss portion 17B is provided on the outer circumferential wall thereof with a core portion 17A around which the spiral spring 18 is designed to be wound. The core portion 17A is provided with an internal end-fastening portion 17C forming a longitudinal groove having a U-shaped cross-section so as to enable a ring-shaped internal hook end 18*b* of the spiral spring 18 to be fitted and engaged therewith.

The outer diameter of the core portion 17A may be made almost identical with the effective inner diameter of the first turn N1 of the spiral spring 18. The effective outer diameter of the spiral spring 18 under the freely released condition thereof may be made almost identical with the effective inner diameter of the spiral spring-housing cylindrical portion 16A of the spiral spring case 16.

Additionally, according to this embodiment, the rotational axial line O of the spiral spring mechanism 15 is displaced from the proper center K of the spiral spring 18 shown in FIG. 5 by a predetermined distance "e" toward the external hook end 18*a*. In other words, under the assembled condition of the spiral spring mechanism 15, where the spiral spring 18 is housed inside the spiral spring-housing cylindrical portion 16A of the spiral spring case 16, where the core portion 17A of the actuating pulley 17 is fitted in the inner circumferential wound portion Mi of the spiral spring 18, and where the external hook end 18*a* and internal hook end 18*b* of the spiral spring 18 are anchored to the external end-fastening stub 16C and the internal end-fastening portion 17C, respectively, the center of the inner circumferential wound portion Mi of the spiral spring 18 is decentered from the proper center K of the spiral spring 18 by the predetermined distance "e" toward the external hook end 18*a*. As a result, the range of contact between the first turn N1 and the second turn N2 of the spiral spring 18 is increased, thereby improving the retention force of the spiral spring 18 to enable it to wind around the core portion 17A of the actuating pulley 17.

As clearly shown in FIGS. 1 and 6, the one-way clutch 100 mounted on the outer periphery side of the spiral spring case 16 includes a couple of claw members 120 which are swingably mounted on the radially enlarged portion 11C of the outer case member 11A of the starter case 11 in such a way that they are disposed around the rotational axial line O and spaced apart from each other at an angle of 180 degrees. The one-way clutch 100 further includes a couple of torsion coil springs 13 acting as urging members for urging the claw members 120 radially inward or toward the outer peripheral surface of the spiral spring-housing cylindrical portion 16A. It also includes three engaging portions 101, 102 and 103 which are projected from the outer peripheral wall of the spiral spring-housing cylindrical portion 16A of the spiral spring case 16 and spaced apart from each other at an angle of 120 degrees, respectively. Thus, when any one of the claw members 120 is contacted and engaged with any one of the engaging portions 101, 102 and 103, the spiral spring case 16 is prevented from rotating in the direction L which is opposite to the driving direction R of the spiral spring case 16.

The claw members 120 may be L-shaped, and the axis 120*a* thereof may be designed to be rotatably secured, e.g., by means of a C-shaped ring 135, to the radially enlarged portion 11C of the outer case member 11A, and also designed to be slidably sustained by a reinforcing receiver 11*f* which is formed in the radially enlarged portion 11C of the outer case member 11A.

Between the outer case member 11A and the spiral spring case 16, there is disposed a rope pulley 20 having a stepped disc-like configuration (see FIG. 1). The rope pulley 20 is provided on the outer peripheral wall thereof with an annular groove 20*a* so as to enable the recoil rope 21 to be wound around it. The rope pulley 20 is further provided at the center of its inner periphery with a cylindrical boss 26 which is designed to be rotatably fitted on the cylindrical boss portion 16*a* of the spiral spring case 16. The cylindrical boss 26 is provided with a pair of claw-retaining portions 27A and 27B (see FIG. 2) to be engaged with a recoil ratchet mechanism 40, and a pair of spring retaining portions 28A and 28B see (FIG. 2) each corresponding to the claw-retaining portions 27A and 27B, respectively. These spring retaining portions 28A and 28B, as well as the claw-retaining portions 27A and 27B, are respectively spaced apart from each other at an angle of 180 degrees and radially extended outward, thereby forming a cross-shaped or generally x-shaped configuration constituted by a total of these four portions.

Figure 7:
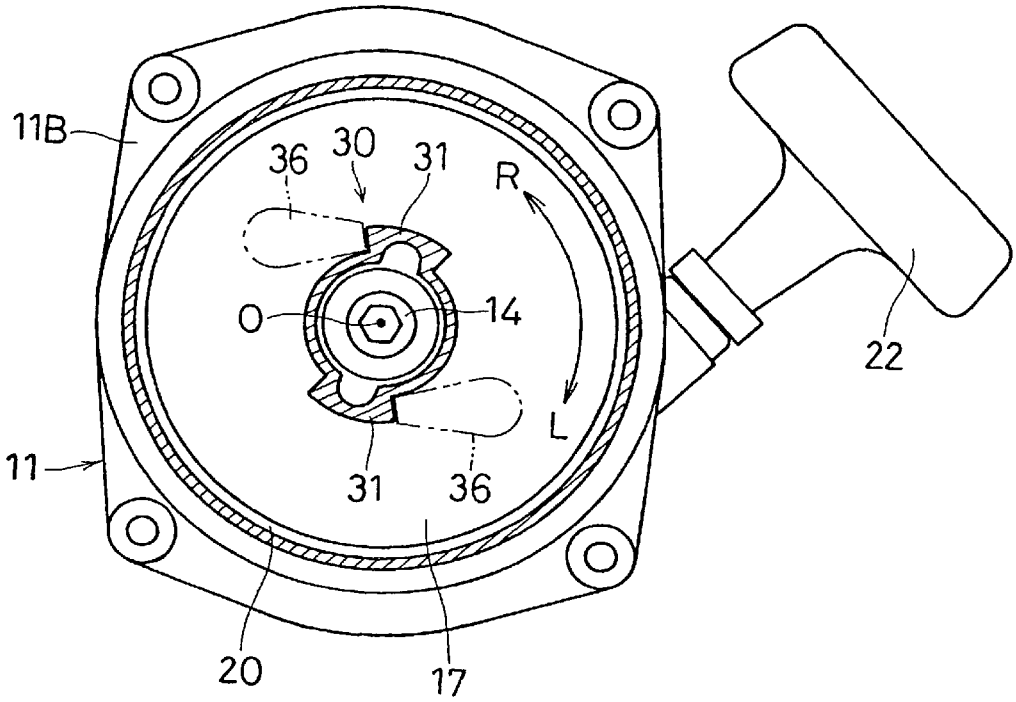
FIG. 7 is a sectional view taken along the line VII—VII of FIG. 1.

In the same manner as in the case of the conventional recoil type starter, although details are not shown in the drawings, one end of the rope 21 is fastened to a bottom portion of the groove 20*a*, while the other end of the rope 21 which is extended out of the outer case member 11A is fastened to a recoil handle 22 (see FIG. 7).

Furthermore, between the rope reel 20 and the outer case member 11A, there is interposed a recoil spiral spring 23 functioning as the recoil urging means, the outer end of which is fastened to the rope reel 20, and the inner end of which is fastened to a central portion of the outer case member 11A. The rope reel 20 is designed to be rotated by pulling the rope 21, and then allowed to return to the original portion on account of the restoring force accumulated in the recoil spiral spring 23, thereby enabling the rope 21 to be automatically rewound.

Figure 2:
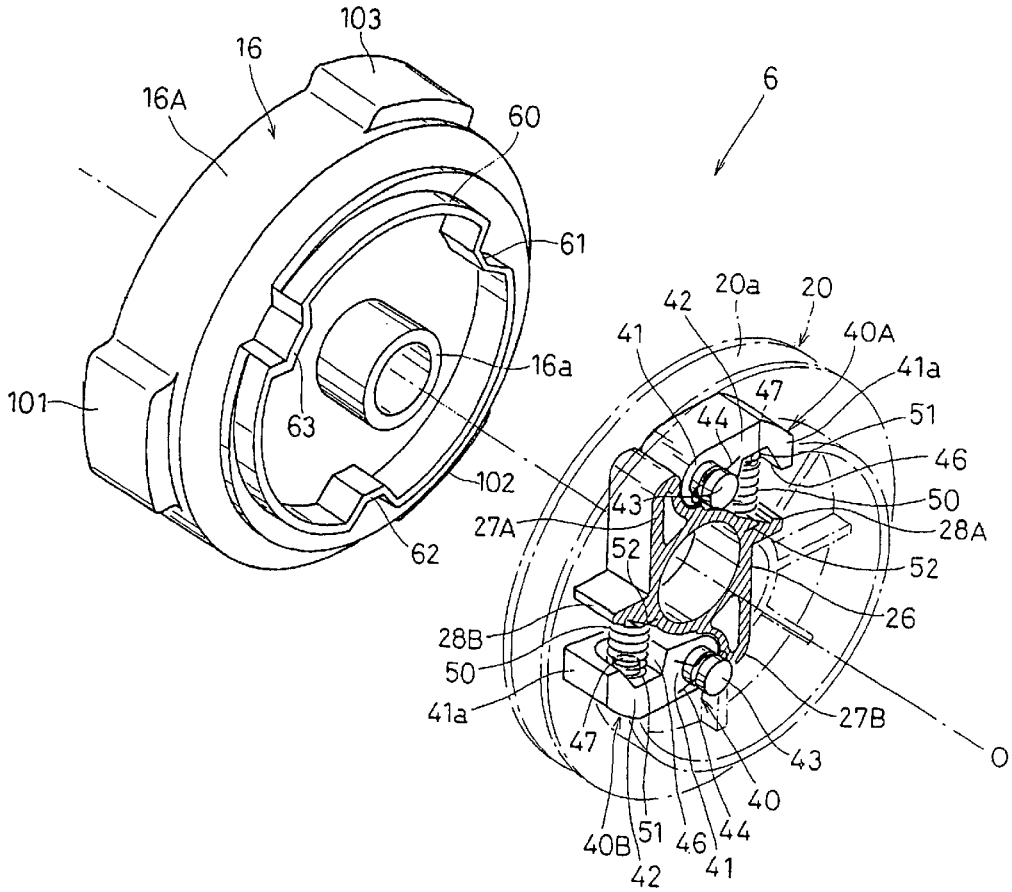
FIG. 2 is a partial perspective view illustrating a recoil ratchet mechanism interposed between a rope reel and a spiral spring case, which are designed to be installed in the recoil starter of FIG. 1 in accordance with the present invention.
Figure 3A:
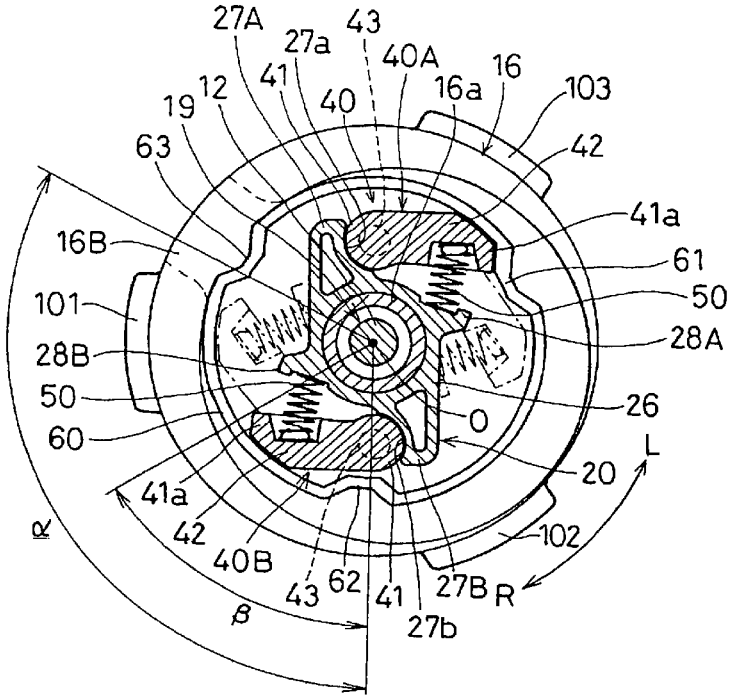
FIG. 3A is a cross-sectional view of the ratchet mechanism of FIG. 2 taken along the line III—III of FIG. 1 as one ratchet claws engages one of the trapezoidal engaging portions.
Figure 3B:
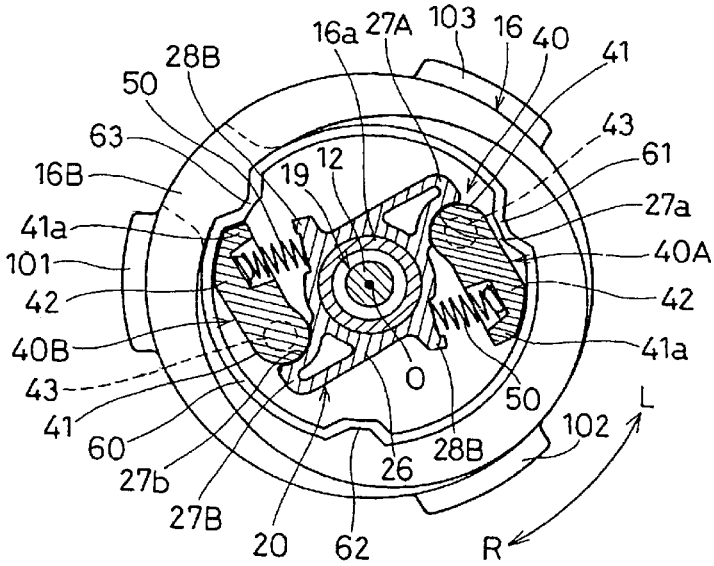
FIG. 3B is a cross-sectional view of the ratchet mechanism of FIG. 2 portions taken along the line III—III of FIG. 1 as the other ratchet claw engages one of the trapezoidal engaging.

As illustrated in FIGS. 2, 3A and 3B, a recoil ratchet mechanism 40 interposed between the rope reel 20 and the spiral spring case 16. The recoil ratchet mechanism 40 comprises, on one of the sidewalls of the rope pulley 20 facing the spiral spring case 16, a couple of ratchet claws 40A and 40B which are spaced apart from each other at an angle 180 degrees and enabled respectively to swing. A couple of compression coil springs 50 function respectively as an urging member for urging the ratchet claws 40A and 40B to turn outwardly in the radial direction. A short cylindrical claw-receiving portion 60 projects from one of the sidewalls of the spiral spring case 16 facing the rope pulley 20. The claw-receiving portion 60 is provided with three trapezoidal engaging portions 61, 62 and 63 which are spaced apart from each other at an angle $\alpha$ (an angle of 120 degrees in this embodiment) and are depressed inwardly.

Each of the ratchet claws 40A and 40B includes a proximal end portion 41 having a semi-cylindrical surface and an oscillating axis 43 which is rotatably fitted in a bearing hole 25*a* formed in the plate portion 25 of the rope pulley 20 and located close to each of the claw-retaining portions 27A and 27B. Each of the ratchet claws 40A and 40B also includes an arm portion 42 extended from the proximal end 41 and having an inwardly bent distal end 41*a*. The semi-cylindrical surface of the proximal end portion 41 is designed to be slidably contacted with the claw-retaining portion 27A or 27B. A locking pin 44 is inserted into and fixed to the distal end portion of the oscillating axis 43.

Between the arm portions 42 and a pair of the spring retaining portions 28A and 28B of the cylindrical boss portion 26 of the rope pulley 20, there is interposed a pair of the compression coil springs 50, each functioning as an urging member for always urging the ratchet claws 40A and 40B to turn outwardly in the radial direction, thereby enabling the bent distal end portion 41*a* to be pressed against the claw-receiving portion 60 of the spiral spring case 16, whereby the bent distal end portions 41*a* are permitted to be engaged, in a proper posture, with the engaging portions 61, 62 and 63.

In this case, one end portion 51 of each of the compression coil springs 50 is inserted into a disengagement-preventing recessed portion 46 which is provided at the distal end of the arm portion 42 of each of the ratchet claws 40A and 40B, and at the same time, the one end portion 51 of each of the compression coil springs 50 is externally fitted over a disengagement-preventing protruded portion 47 which is projected inside the recessed portion 46. The other end portion 52 of each of the compression coil springs 50 is bent in the form of a hook so as to be introduced into and engaged with a hanging hole formed in the rope reel 20.

The driven member 7 includes the interlocking pulley 35 and a centrifugal clutch type ratchet mechanism 30, as illustrated in FIG. 7. The centrifugal ratchet mechanism 30 comprises a pair of power transmission engaging protrusions 31 which are projected from one of the sidewalls of the actuating pulley 17 facing the engine 1, and the interlocking pulley 35 which is anchored to the one end 2*a* of the crankshaft 2. A couple of starting claws 36, e.g., may be swingably supported by the interlocking pulley 35. The starting claws 36 are generally urged to turn inward (toward the rotational axial line O) by means of biased springs (not shown), thereby enabling the starting claws 36 to be engaged with the power transmission engaging protrusions 31. However, when the engine 1 is started, the starting claws 36 are caused to swing radially outward due to the centrifugal force generated by the rotation of the interlocking pulley 35 that has been driven by the crankshaft 2, thereby automatically disengaging the aforementioned engagement between the claws 36 and the protrusions 31.

In this embodiment, when the recoil rope 21 (or the recoil handle 22) is manually pulled, the rope pulley 20 is caused to revolve clockwise (in the direction of R shown in FIGS. 3A and 3B), whereby a couple of the ratchet claws 40A and 40B (which are spaced apart from each other at an angle of 180 degrees) rotate integrally with the rope pulley 20. When the ratchet claws 40A and 40B begin to rotate, one of the ratchet claws, e.g., the ratchet claw 40A, comes into contact with one of three engaging portions 61, 62 and 63 (spaced apart at an angle of 120 degrees [= ]) that have been provided in the spiral spring case 16, e.g. with the engaging portion 61, as shown in FIG. 3(A). At this point, the other ratchet claw 40B is positioned at a place which is spaced apart at a predetermined angle $\beta$ (180°−120°=60°) from the other two engaging portions 62 and 63.

In this case, since the aforementioned other ratchet claw 40B is positioned away from the engaging portions 61, 62 and 63, the ratchet claw 40B is kept in a proper state where the bent distal end portion 41*a* is pressed onto the claw-receiving portion 60 provided in the spiral spring case 16 due to the urging force of the compression coil spring 50 so as to enable the bent distal end portion 41*a* to be properly engaged with the engaging portions 61, 62 and 63.

In this embodiment, even if one of the ratchet claws, e.g. the ratchet claw 40A, rides over the engaging portion 61, the other ratchet claw 40B is enabled, under a proper state, to be immediately contacted with the engaging portion 62 as soon as the rope reel 20 is slightly rotated as shown in FIG. 3(B), thereby enabling the rotation (or torque) of the rope reel 20 to be reliably transmitted to the spiral spring case 16.

Therefore, it is possible, with the recoil starter 5 of this embodiment, to suppress the generation of loss in the pulling operation of the recoil rope, to prevent the pulling operation of the recoil rope from becoming vacant, and to obtain a smooth pulling feeling of the recoil rope. This is in contrast to the conventional structure, in which, upon one of the ratchet claws, e.g., claw 40A, riding over an engaging portion, e.g., portion 61, without proper engagement therewith (as shown in phantom in FIG. 3A), the ratchet claws continue to ride over the engagement portions, one after another, with consequent substantial loss in the pulling operation of the rope.

Furthermore, since the compressing coil spring 50 is employed as an urging member with one end portion 52 thereof being formed into a hook-like configuration so as to enable it to be secured to the rope reel 20, the urging member can be prevented from being easily disengaged from the rope reel 20, thereby improving the reliability of the recoil starter.

When the operation of pulling the rope 21 is performed in this manner, the torque of the driving member 6 can be transmitted, via the spiral spring mechanism 15 and the interlocking pulley 35, to the crankshaft 2 of the engine 1.

In this case, during the first-half of the driving process (until the piston of the engine 1 reaches the top dead center of internal combustion engine) in the operation of pulling the recoil rope 21 (recoiling operation), a buffering effect is derived from the spiral spring mechanism 15 and, at the same time, the pulling force of the recoiling rope 21 is accumulated in the spiral spring mechanism 15. During the second-half of the driving process, the pulling force thus accumulated in the spiral spring mechanism during the first-half driving process is combined with the additional pulling force actually effected by the recoiling rope 21 in the second-half of the driving process, to thereby generate a resulting force of sufficient energy to overcome the load of the engine compression and start the engine 1. As a result, it is possible to minimize fluctuation in the pulling force of the rope 21 so as to allow for a smooth rope-pulling operation, thus enabling even a person having weak physical strength to easily start the engine. Further details in this regard are disclosed in published Japanese Patent Application No. H11-238642, the subject matter of which is hereby incorporated by reference.

When the engine 1 is started and the recoil rope 21 is released, the rope reel 20 is caused to reversely rotate (the rotation in the reverse direction L) due to the restoring force that has been accumulated in the recoiling spiral spring 23, thereby allowing the recoil rope 21 to be automatically rewound. However, the rope reel 20 is also caused to reversely rotate, thereby enabling any one of the claw members 120 in the one-way clutch 100 to contact and engage with any one of the engaging portions 101, 102 and 103 as shown in FIG. 6, so that the spiral spring case 16 can be prevented from rotating in the reverse direction L. As a result, the accumulated force of the spiral spring 18 is prevented from being released in vain.

In this embodiment, since the one-way clutch 100 provided for rotating the spiral spring case 16 of the spiral spring mechanism 15 in only driving direction R is disposed on the outer peripheral side of the spiral spring case 16, the diameter of the one-way clutch 100 can be made fairly large. As a result, it is now possible to enable the one-way clutch 100 to sustain large torque. Additionally, since it is no longer required for each of the parts constituting the recoil starter to have high mechanical strength, high rigidity and high working precision, the manufacturing cost for the recoil starter can be reduced, and the reliability of the recoil starter can be enhanced. At the same time, it is also possible to reduce the weight of the recoil starter by making use of plastic materials as much as possible.

Furthermore, in the case of the recoil starter 5 according to this embodiment, since it is constructed such that part of the second turn N2 is closely contacted with the first turn N1 at the inner circumferentially wound portion Mi of the spiral spring 18, that the internal hook end 18*b* is displaced as mentioned above, and that the specifications of the spiral spring 18 and the spiral spring mechanism 15 are designed as explained above, the interlocking between the spiral spring mechanism 15 and the engine 1 are disengaged from each other after the start-up of the engine due to the free releasing effects obtained from the centrifugal ratchet mechanism 30 mounted on the driven member 7, thereby rendering the spiral spring mechanism 15 into a free state. In this case, even if the spiral spring 18 is excessively kicked back in the unwinding direction (releasing direction) thereof due to the inertia, even after the spiral spring 18 has been completely unwound, the kick-back stress to be repeated by the effects of rewinding-unwinding on this occasion is received by the entire body of the inner circumferentially wound portion Mi, thereby making it possible to suppress the concentration of the stress in the vicinity of the internal hook end 18*b* of the spiral spring 18.

As a result, the generation of settling or breakage of the spiral spring 18 can be prevented, thereby making it possible to improve the durability of the spiral spring 18. The internal hook end 18*b* of the spiral spring 18 can be also prevented from being easily disengaged from the core portion 17C, provided at the actuating pulley 17 of the spiral spring mechanism 15, thereby further improving reliability of the recoil starter.

While one embodiment of the present invention has been explained in detail for the purpose of illustration, it will be understood that the construction of the device can be varied without departing from the spirit and scope of the invention.

Figure 8:
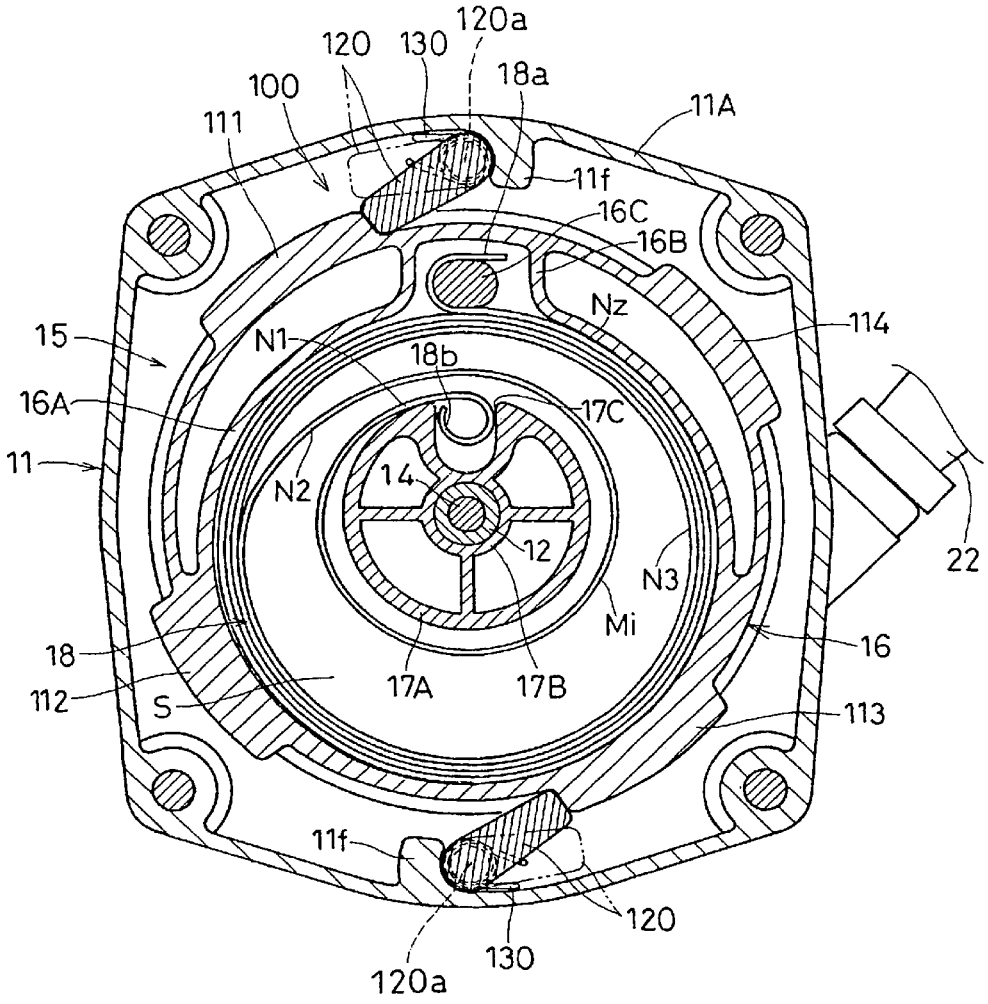
FIG. 8 is a cross-sectional view illustrating a modified example of the one-way clutch of the recoil starter shown in FIG. 1.

As seen from the above explanation, it is possible, according to the present invention, to enable the engaging portions 101, 102 and 103 to project from the outer peripheral wall of the spiral spring-housing cylindrical portion 16A of the spiral spring case 16 and to be spaced apart from each other at an angle of 120 degrees, respectively, thereby enabling any one of the claw members 120, which are provided in the outer case member 11A and spaced away from each other at an angle of 120 degrees, to contact and engage with any one of the engaging portions 101, 102 and 103 to thereby prevent the spiral spring case 16 from rotating in the reverse direction L. This structure, however, may be substituted by an alternative structure as shown in FIG. 8, wherein four engaging portions 111, 112, 113 and 114 are provided projecting from the outer peripheral wall of the spiral spring-housing cylindrical portion 16A of the spiral spring case 16 and being spaced apart from each other at an angle of 90 degrees, respectively, thereby enabling a couple of the claw members 120, which are provided in the outer case member 11A and spaced away from each other at an angle of 120 degrees, to contact and engage with any two of these engaging portions 111, 112, 113 and 114, to thereby prevent the spiral spring case 16 from rotating in the reverse direction L.

When the engaging portions are provided in this manner, the idling angle (the engaging intervals) can be minimized, thereby further promoting reliability by preventing the rotation of the spiral spring case 16 in the reverse direction L.

As clearly seen from the above explanation, it is possible, according to the present invention, to increase the diameter of the aforementioned unidirectional rotating means since the unidirectional means is disposed on the outer peripheral side of the housing. As a result, it is now possible to make the one-way clutch sustain a large magnitude of torque. Additionally, since it is no longer required for each of the parts constituting the recoil starter to have high mechanical strength, high rigidity and high working precision, the manufacturing cost for the recoil starter can be reduced and, at the same time, the reliability of the recoil starter can be enhanced and the weight of the recoil starter can be reduced as a whole.

What is claimed is:

1. A recoil starter, comprising:

a rotatable driving member, a rotatable driven member, and buffering/power-accumulating means interposed between said driving member and said driven member, said buffering/power-accumulating means including an inner housing operatively coupled to said driving member for rotation about an axis; and an actuating pulley operatively coupled to said driven member for rotation about an axis; and a buffering/power-accumulating member interposed between said housing and said actuating pulley; and unidirectional rotating means, disposed on the outer peripheral side of said inner housing, for permitting unidirectional rotation of said inner housing; the driving direction R only;

said buffering/power-accumulating means being adapted, during a driving process of said driving member, to accumulate power supplied by the driving of said driving member while alleviating impact; and said driven member being operatively coupled to said buffering/power accumulating member to be actuated by the power accumulated therein;

wherein said unidirectional rotating means comprises a one-way clutch;

wherein said recoil starter comprises an outer housing surrounding said inner housing; and said one-way clutch comprises:

one or more claw members which are swingably supported by one of said inner housing and said outer housing;

an urging member for urging each of said claw members towards the other of said inner housing and said outer housing, and one or more engaging portions provided on said other of said inner housing and said outer housing, wherein at least one of said claw members is adapted to be engaged with at least one of said one or more engaging portions, thereby preventing said inner housing from being rotated in the direction L opposite to said driving direction R;

a plurality of said claw members, said claw members being mounted on said inner housing so as to be disposed around the rotational axis thereof and equally spaced from each other; and a plurality of said engaging portions disposed on said outer housing and equally spaced from each other.

2. The record starter according to claim 1, wherein:

there are two of said claw members spaced apart from each other around the rotational axis of said inner housing by an angle of 180 degrees; and there are three of said engaging portions spaced apart from each other by an angle of 120 degrees.

3. The recoil starter according to claim 1, wherein:

there are two of said claw members spaced apart from each other around the rotational axis of said inner housing by an angle of 180 degrees; and there are four of said engaging portions spaced apart from each other by an angle of 90 degrees.

4. The recoil starter according to claim 1 wherein said buffering/power-accumulating member comprises a spiral spring operatively coupled to said inner housing.

5. The recoil starter according to claim 1, wherein:

said driving member comprises a rope reel having a recoil rope wound there around; and said recoil starter further comprises recoiling urging means for reversely revolving said rope reel so as to rewind said recoil rope, and a recoil ratchet mechanism for transmitting the torque of said rope reel to said inner housing.

6. The recoil starter according to claim 1, wherein said driven member comprises an interlocking pulley having a power transmission mechanism through which said driven member is operatively interlockingly coupled to said buffering/power-accumulating means.

7. The recoil starter according to claim 6, wherein said power transmission mechanism comprises a centrifugal ratchet mechanism.

8. The recoil starter according to claim 4, wherein said spiral spring comprises:

an outer circumferential wound portion, Mo, a predetermined number of turns of said outer circumferentially wound portion Mo of the spiral spring being in close contact with each other in the freely released condition of the spiral spring;

an inner circumferential wound portion Mi which is constituted by at least one turn of said inner circumferentially wound portion Mi of said spiral spring; and wherein a clearance is provided between said outer circumferential wound portion Mo and said inner circumferential wound portion Mi.

9. The recoil starter according to claim 8, wherein:

said outer circumferential wound portion Mo comprises a third turn and the following turns successive to said third turn; and said inner circumferential wound portion Mi comprises a first turn and at least a portion of the second turn which is in close contact with said first turn.

* * * * *

UNITED STATES PATENT AND TRADEMARK OFFICE

CERTIFICATE OF CORRECTION

PATENT NO. : 6,679,217 B2
DATED : January 20, 2004
INVENTOR(S) : Nieda et al.

It is certified that error appears in the above-identified patent and that said Letters Patent is hereby corrected as shown below:

Title page,
Item [73], Assignee, "Starting Industrial Co., Ltd., Tokyo, (JP)" should read -- Starting Industrial Co., Ltd., and Kioritz Corporation, Tokyo, (JP) --.

Signed and Sealed this

Seventh Day of September, 2004

JON W. DUDAS
*Director of the United States Patent and Trademark Office*